US007243640B2

(12) United States Patent
Kondo

(10) Patent No.: US 7,243,640 B2
(45) Date of Patent: Jul. 17, 2007

(54) FUEL FLOW PATH MODULE IN INLINE PUMP TYPE FUEL INJECTION APPARATUS

(75) Inventor: Yasushi Kondo, Kawasaki (JP)

(73) Assignee: Keihin Corporation, Shinjuku-ku, Tokyo (JP)

( * ) Notice: Subject to any disclaimer, the term of this patent is extended or adjusted under 35 U.S.C. 154(b) by 17 days.

(21) Appl. No.: 11/291,769

(22) Filed: Dec. 2, 2005

(65) Prior Publication Data

US 2006/0124111 A1 Jun. 15, 2006

(30) Foreign Application Priority Data

Dec. 10, 2004 (JP) ..... 2004-357550

(51) Int. Cl.
*F02M 37/08* (2006.01)
*F02M 37/20* (2006.01)

(52) U.S. Cl. ..... 123/516; 123/511; 123/514

(58) Field of Classification Search ..... 123/511, 123/514, 516
See application file for complete search history.

(56) References Cited

U.S. PATENT DOCUMENTS 4,622,935 A * 11/1986 Janisch ..... 123/198 DC
5,078,233 A * 1/1992 Oetting et al. ..... 184/6.5
5,235,944 A * 8/1993 Adachi ..... 123/196 R
5,458,101 A * 10/1995 Crooks ..... 123/196 S
5,584,278 A * 12/1996 Satoh et al. ..... 123/516
5,749,345 A * 5/1998 Treml ..... 123/514
6,851,458 B2 * 2/2005 Nakajima et al. ..... 123/516
2005/0263141 A1 * 12/2005 Tsuruta ..... 123/516

FOREIGN PATENT DOCUMENTS

JP 11-301556 2/1999
JP 2000-238680 5/2000

* cited by examiner

*Primary Examiner*—Erick Solis
(74) *Attorney, Agent, or Firm*—Bacon & Thomas, PLLC

(57) ABSTRACT

To make a length in a horizontal direction of a vapor return joint small, thereby improving an assembling property of a fuel flow path module to a fuel tank, a vapor inflow hole, a fuel outflow hole and a regulator fuel inflow hole are provided in a fuel tube portion of a fuel flow path module, a vapor return joint is provided uprightly in an upper side of the vapor inflow hole, the vapor return joint comprises by a first straight pipe portion, and a second straight pipe portion connected to an upper end of the first straight pipe portion at a narrow angle A downward, an intersection between the first straight pipe portion and the second straight pipe portion is arranged above an upper opening end of the second straight pipe portion.

1 Claim, 2 Drawing Sheets

(PRIOR ART)

FUEL FLOW PATH MODULE IN INLINE PUMP TYPE FUEL INJECTION APPARATUS

BACKGROUND OF THE INVENTION

1. Field of the Invention

The present invention relates to a fuel injection apparatus which boosts fuel stored within a fuel tank by a fuel pump, adjusts a pressure of the boosted fuel to a predetermined pressure by a pressure regulator, and supplies the fuel to an engine via a fuel injection valve, and more particularly to a fuel flow path module used in an inline pump type fuel injection apparatus in which the fuel pump is arranged in an outer side of the fuel tank, and is arranged within a fuel inflow pipe extending toward an outer side from the fuel tank.

2. Description of the Conventional Art

A description will be given of a fuel flow path module in a conventional inline pump type fuel injection apparatus with reference to FIG. 2.

A fuel flow path module M in which a plurality of fuel flow paths are respectively formed independently is formed in the following manner.

Reference numeral 1 denotes a fuel tube portion formed in a tubular shape in a vertical direction. An attaching collar portion 1*a* formed in a flat shape toward a side portion from an outer periphery of the fuel tube portion 1 is formed in the fuel tube portion 1, and a screw insertion hole 1*b* is provided through in the attaching collar portion 1*a*.

Further, a vapor inflow hole 2, a fuel outflow hole 3 and a regulator fuel inflow hole 4 which are independent from each other are provided from a lower end 1*c* of the fuel tube portion 1 toward an upper end 1*d*.

In other words, the holes 2, 3 and 4 are open to the lower end 1*c* and the upper end 1*d*.

Further, a vapor return joint 5 is pressure inserted to and provided uprightly in an opening portion to the upper end 1*d* of the vapor inflow hole 2.

The vapor return joint 5 mentioned above is formed by a metal pipe member, and is formed by a straight pipe portion 5*a* directed toward an upper side, and a U-shaped pipe portion 5*b* bent in an inverse-U shape from an upper end of the straight pipe portion 5*a*, and a lower opening portion 5*ba* of the U-shaped pipe portion 5*b* is open toward a lower side.

Further, a pressure regulator R is inserted to the opening portion to the upper end 1*d* of the regulator fuel inflow hole 4 so as to be arranged to be connected.

Reference symbol K denotes a sealed-state pump receiving case arranged at a lower position of the fuel tank T, a fuel inflow hole 6 is open to a lower side of the pump receiving case, and a vapor discharge hole 7 is open to an upper side thereof.

The fuel pump P is provided with a motor Pm and an impeller Pa driven by the motor Pm, and a pressure difference is generated between front and rear sides of a blade groove in an outer periphery of an impeller Pa on the basis of a rotation of the impeller Pa, whereby the fuel is sucked into a pump chamber from a pump suction path Pb, and the boosted fuel is discharged from a pump discharge path Pc. Further, a strainer S is arranged in the pump suction path Pb.

Further, the fuel pump P provided with the strainer S is arranged within the pump receiving case K. At this time, a fuel chamber Ka which can store the fuel is formed between an inner periphery of the pump receiving case K and an outer periphery of the fuel pump P.

Reference symbol D denotes a fuel distribution pipe in which a fuel distribution path 8 is provided. A fuel injection valve J is inserted and supported to the fuel distribution pipe D, and the fuel supplied into the fuel distribution path 8 is supplied toward the fuel injection valve J.

The fuel flow path module M is fixedly arranged in the fuel tank T in the following manner.

A module insertion hole Tb to which the fuel tube portion 1 of the fuel flow path module M can be inserted is provided in a bottom portion Ta of the fuel tank T.

Further, an upper side portion of the fuel tube portion 1 including the vapor return joint 5 of the fuel flow path module M and the pressure regulator R is inserted and arranged within the fuel tank T via the module insertion hole Tb, and an upper surface of the attaching collar portion 1*a* is arranged so as to be brought into contact with the bottom portion Ta of the fuel tank T via a packing 9. In the state mentioned above, a screw 10 is inserted into the screw insertion hole 1*b* of the attaching collar portion 1*a*, and the attaching collar portion 1*a* is fixed by screw toward the bottom portion Ta of the fuel tank T.

In accordance with the structure mentioned above, the fuel flow path module M is fixedly arranged in the bottom portion Ta of the fuel tank T, the module insertion hole Tb of the fuel tank T is closed by the attaching collar portion 1*a*, the pressure regulator R including the vapor return joint 5 and the return fuel hole Ra is received and arranged within the fuel tank T, and lower sides of the vapor inflow hole 2, the fuel outflow hole 3 and the regulator fuel inflow hole 4 are open to the lower end 1*c* of the fuel tube portion 1.

Further, the fuel flow path module M, the pump receiving case K and the fuel distribution pipe D are connected by flow paths in the following manner.

The fuel out flow hole 3 of the fuel flow path module M and the fuel inflow hole 6 of the pump receiving case K are connected by a fuel inflow pipe 11.

The discharge path Pc of the fuel pump P and the fuel distribution path 8 of the fuel distribution pipe D are connected by a fuel outflow pipe 12.

Further, a regulator fuel pipe 13 branched from the fuel outflow pipe 12 is connected to the regulator fuel inflow hole 4 of the fuel flow path module M.

Further, the vapor discharge hole 7 of the pump receiving case K and the vapor inflow hole 2 of the fuel flow path module M are connected by a vapor relief pipe 14.

In accordance with the inline pump type fuel injection apparatus formed in the manner mentioned above, the fuel stored within the fuel tank T is supplied into the fuel chamber Ka of the pump receiving case K via the fuel outflow hole 3, the fuel inflow pipe 11 and the fuel inflow hole 6, the fuel pump P sucks the fuel supplied into the fuel chamber Ka into the fuel pump P via the strainer S and the pump suction path Pb, and the fuel boosted by the fuel pump P is discharged into the fuel outflow pipe 12 via the pump discharge path Pc.

Further, a part of the fuel within the fuel outflow pipe 12 is supplied to the pressure regulator R via the regulator fuel pipe 13 and the regulator fuel inflow hole 4, and is adjusted to a predetermined pressure by the pressure regulator R.

An excess fuel at a time of being adjusted by the pressure regulator R is returned into the fuel tank T via the return fuel hole Ra.

In accordance with the structure mentioned above, the fuel having the pressure adjusted to the predetermined fuel pressure is supplied toward the fuel distribution path 8 of the fuel distribution pipe D from the fuel outflow pipe 12, and the fuel within the fuel distribution path 8 is injected and supplied toward the engine (not shown) via the fuel injection valve J.

On the other hand, if the fuel inflow pipe 11 is warmed up by a heat radiation from the engine or an outside air temperature, a vapor is generated in the fuel flowing within the fuel inflow pipe 11, and the vapor flows into the fuel chamber Ka within the receiving case K from the fuel inflow hole 6.

Further, if the fuel pump P is driven, the motor Pm generates heat, the fuel within the fuel chamber Ka is warmed up on the basis of the heat generation of the motor Pm and the vapor is generated.

Further, if the fuel pump P is driven and the impeller Pa rotates within the pump chamber, the vapor is generated within the pump chamber, and the vapor is discharged into the fuel chamber Ka via a vapor bleeding hole Pd of the fuel pump P.

Further, the vapor generated in the manner as mentioned above is discharged into the fuel tank T via the vapor discharge hole 7, the vapor relief pipe 14, the vapor inflow hole 2 and the vapor return joint 5 through an upper space of the fuel chamber Ka.

Further, in the vapor return joint 5, an upper end of the straight pipe portion 5*a* is bent in the inverse-U shape toward the lower side by the U-shaped pipe portion 5*b*. Accordingly, even if the vapor return joint 5 is in a state of being arranged so as to be immersed into the fuel within the fuel tank T, the fuel within the fuel tank T is prevented from flowing toward the inner side of the vapor relief pipe 14.

This is because a peak 5*bb* of the U-shaped pipe portion 5*b* is arranged in an upper side of the lower opening portion 5*ba*.

DETAILED DESCRIPTION OF PREFERRED EMBODIMENT

Figure 2:
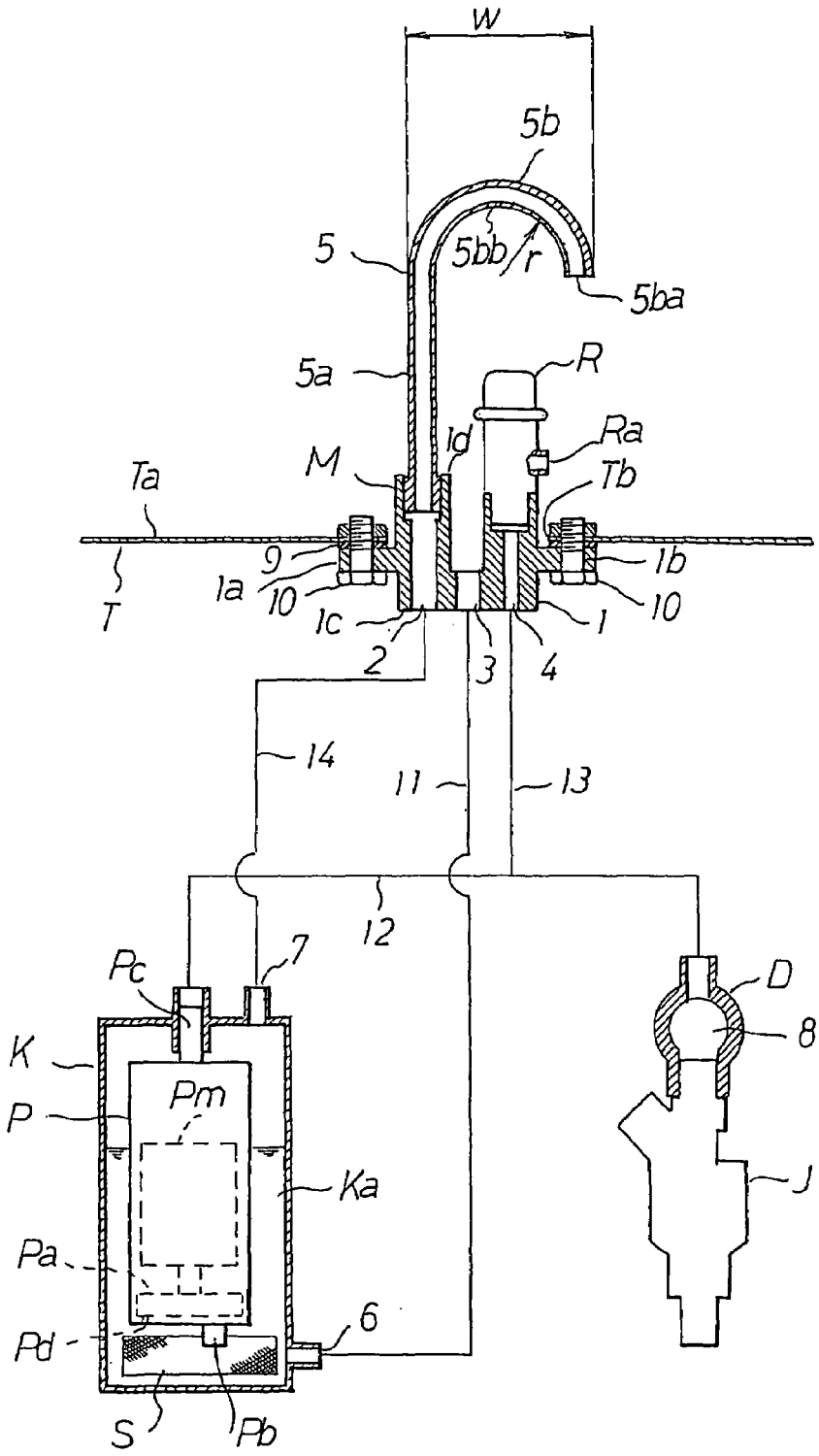
FIG. 2 is a vertical sectional view of a main portion showing an embodiment of a fuel flow path module in a conventional inline pump type fuel supply apparatus.

In accordance with the vapor return joint 5 of the conventional fuel flow path module M mentioned above, it is impossible to make a length W in a horizontal direction in FIG. 2 of the vapor return joint 5 small.

This is because a bending radius r of the U-shaped pipe portion 5*b* depends on a pipe diameter d of the vapor return joint 5, and it is necessary to set the bending radius r to be twice as large as the pipe diameter d or more.

If the bending radius r is less than double of the pipe diameter d, the U-shaped pipe portion 5*b* is collapsed, a cross sectional area of the pipe diameter is largely reduced, and it is impossible to execute a good vapor bleeding.

As mentioned above, in accordance with the structure in which the length W in the horizontal direction of the vapor return joint 5 is large, the vapor return joint 5 is inserted while being inclined and screw rotated at a time of inserting the vapor return joint 5 of the fuel flow path module M into the fuel tank T via the module insertion hole Tb of the fuel tank T. Accordingly, an assembling property of the fuel flow path module is deteriorated, and there is a risk that the pressure regulator R is brought into contact with the module insertion hole Tb so as to be damaged.

Further, it is possible to move the vapor return joint 5 in a linear direction so as to insert into the fuel tank T, by enlarging the hole diameter of the module insertion hole Tb, however, in the case that the module insertion hole Tb is enlarged in diameter, it is necessary to increase a pressing force to the packing 9 in comparison with the conventional structure, and it is necessary to enlarge a diameter of the screw 10 and increase a number of the screw 10.

The present invention is made by taking the problem mentioned above into consideration, and an object of the present invention is to provide a fuel flow path module in which a length in a horizontal direction of a vapor return joint is made smaller in comparison with the conventional structure, and the vapor return joint 5 can be moved in a linear direction so as to be arranged to be inserted into a fuel tank even in the case of using the conventional module insertion hole Tb, thereby improving an assembling property of the fuel flow path module including the vapor return joint to the fuel tank.

In order to achieve the object mentioned above, in accordance with the present invention, there is provided a fuel flow path module in an inline pump type fuel supply apparatus comprising:

a fuel tube portion formed in a vertical direction;

an attaching collar portion formed toward a side portion from an outer periphery of the fuel tube portion;

a vapor inflow hole, a fuel outflow hole and a regulator fuel inflow hole provided toward an upper end from a lower end of the fuel tube portion;

a vapor return joint provided uprightly in an upper side of the vapor inflow hole; and a pressure regulator arranged so as to be connected to the regulator fuel inflow hole, wherein the vapor return joint comprises:

a fuel flow path module which is formed by a first straight pipe portion extending toward an upper side, and a second straight pipe portion arranged so as to be connected at a narrow angle from an upper end of the first straight pipe portion toward a downward direction, and in which an intersection of connection between the first straight pipe portion and the second straight pipe portion is arranged at an upper position from an upper opening end of a lower opening portion of the second straight pipe portion;

a pump receiving case which receives a fuel pump, and in which a fuel inflow hole is open to a lower side and a vapor discharge hole is open to an upper side; and a fuel distribution pipe in which a fuel injection valve is arranged so as to be inserted toward a fuel distribution path, wherein the fuel tube portion provided with the vapor return joint and the pressure regulator of the fuel flow path module is inserted into a fuel tank via a module insertion hole open to a bottom portion of the fuel tank, and the fuel flow path module is fixedly arranged in the fuel tank via an attaching collar portion, and wherein the fuel outflow hole and the fuel inflow hole are connected by a fuel inflow pipe, the vapor discharge hole and the vapor inflow hole are connected by a vapor relief pipe, the pump discharge path and the fuel distribution path are connected by a fuel outflow pipe, and a regulator fuel pipe branched from the fuel outflow pipe is connected to the regulator fuel inflow hole.

In accordance with the fuel flow path module on the basis of the present invention, since the vapor return joint is formed by the first straight pipe portion and the second straight pipe portion arranged so as to be connected at the narrow angle from the upper end of the first straight pipe portion toward the downward direction, and the intersection of connection between the first straight pipe portion and the second straight pipe portion is arranged at the upper position from the upper opening end of the lower opening portion of the second straight pipe portion, it is possible to make the length in the horizontal direction of the vapor return joint smaller in comparison with the conventional length in the horizontal direction.

In accordance with the structure mentioned above, since the fuel tube portion including the vapor return joint can be moved in a linear direction with respect to the module insertion hole of the conventional fuel tank, so as to insert and arrange in the fuel tank it is possible to largely improve an assembling property of the fuel flow path module to the fuel tank.

Further, in accordance with the structure mentioned above, it is possible to prevent the pressure regulator from being brought into contact with the module insertion hole so as to be damaged.

Further, since it is not necessary to expand the hole diameter of the conventional module insertion hole, it is possible to securely close and hold the module insertion hole by the attaching collar portion while using the conventional screw and packing as they are. Further, since the intersection of connection between the first straight pipe portion and the second straight pipe portion is arranged at the upper position from the upper opening end of the lower opening portion of the second straight pipe portion, the fuel within the fuel tank is prevented from flowing into the vapor relief pipe via the vapor return joint even if the vapor return joint is in a state of being arranged so as to be immersed into the fuel within the fuel tank.

A description will be given below of an embodiment of a fuel flow path module in an inline pump type fuel supply apparatus in accordance with the present invention with reference to FIG. 1.

Figure 1:
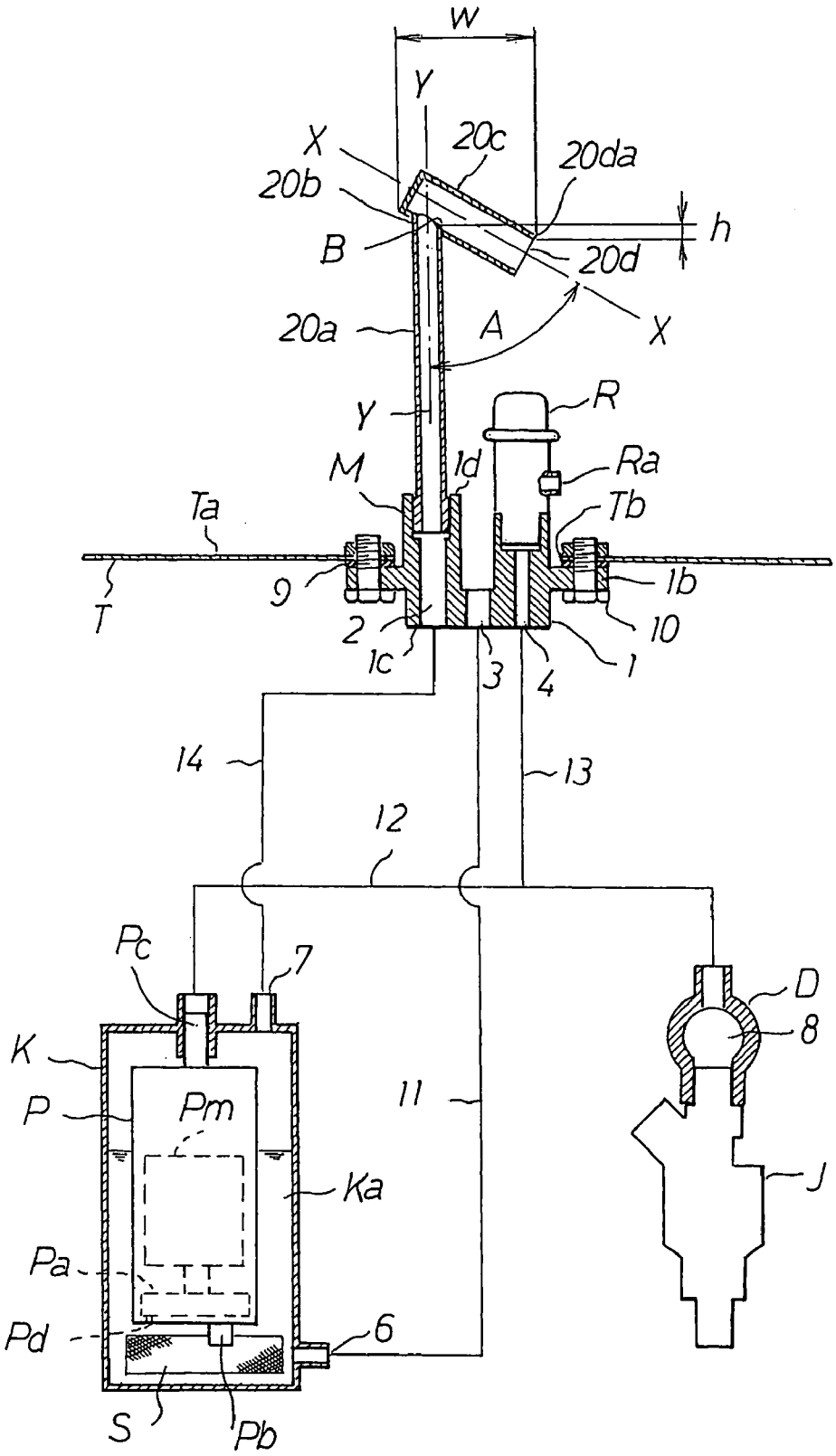
FIG. 1 is a vertical sectional view of a main portion showing an embodiment of a fuel flow path module in an inline pump type fuel supply apparatus in accordance with the present invention.

In this case, FIG. 1 is different from FIG. 2 only in a vapor return joint. Accordingly, a description will be given only of the vapor return joint, and the description in FIG. 2 is applied to the other structures.

A vapor return joint 20 is formed by a first straight pipe portion 20*a* formed by a pipe member and extending toward an upper side, and a second straight pipe portion 20*c* constituted by a pipe member connected toward an obliquely downward right side from an upper end 20*b* of the first straight pipe portion 20*a*.

At this time, a longitudinal axial line X-X of the second straight pipe portion 20*c* is connected so as to be intersected at a narrow angle (an angle A) smaller than 90 degree with respect to a longitudinal axial line Y-Y of the first straight pipe portion 20*a*.

In the present embodiment, the second straight pipe portion 20*c* is arranged so as to be inclined at 60 degree with respect to the first straight pipe portion 20*a*.

In accordance with the structure mentioned above, a lower opening portion 20*d* of the second straight pipe portion 20*c* is open toward an obliquely downward right side. At this time, an intersection B of connection between inner passages of the first straight pipe portion 20*a* and the second straight pipe portion 20*c* is positioned at a distance h above an upper opening end 20*da* of the lower opening portion 20*d* of the second straight pipe portion 20*c*.

Further, a lower side of the first straight pipe portion 20*a* of the vapor return joint 20 is connected so as to be inserted to an upper opening portion of the vapor inflow hole 2 of the fuel flow path module M.

As mentioned above, in accordance with the fuel flow path module M on the basis of the present invention, since the vapor return joint 20 is formed by the first straight pipe portion 20*a* and the second straight pipe portion 20*c* and the second straight pipe portion 20*c* is arranged so as to be connected to the upper end 20*b* of the first straight pipe portion 20*a* at the narrow angle (the angle A), it is possible to make the length W in the horizontal direction of the vapor return joint 20 shorter than the conventional structure. Accordingly, the fuel tube portion 1 provided with the vapor return joint 20 and the pressure regulator R can be arranged so as to be inserted to the module insertion hole Tb of the conventional fuel tank T in the linear direction, and it is possible to largely improve an attaching property of the fuel flow path module M to the fuel tank T.

Further, in accordance with the structure mentioned above, since the pressure regulator R and the vapor return joint 20 are not brought into contact with the module insertion hole Tb, it is possible to prevent them from being damaged.

In this case, the narrow angle (the angle A) is appropriately determined taking the layout of the pressure regulator R or the like into consideration.

Further, since the intersection B of connection between the first straight pipe portion 20*a* and the second straight pipe portion 20*c* is arranged at the upper position of the upper opening end 20*da* of the lower opening portion 20*d* of the second straight pipe portion 20*c*, it is possible to form an air reservoir in the upper portions of the first and second straight pipe portions 20*a* and 20*c* even if the vapor return joint 20 is immersed into the fuel within the fuel tank T. Accordingly, the fuel within the fuel tank T does not flow into the vapor relief pipe 14 via the second straight pipe portion 20*c* and the first straight pipe portion 20*a*.

What is claimed is:

1. A fuel flow path module in an inline pump type fuel supply apparatus comprising:

a fuel tube portion formed in a vertical direction;

an attaching collar portion formed toward a side portion from an outer periphery of the fuel tube portion;

a vapor inflow hole, a fuel outflow hole and a regulator fuel inflow hole provided toward an upper end from a lower end of the fuel tube portion;

a vapor return joint provided uprightly in an upper side of the vapor inflow hole; and a pressure regulator arranged so as to be connected to the regulator fuel inflow hole, wherein said vapor return joint comprises:

a fuel flow path module which is formed by a first straight pipe portion extending toward an upper side, and a second straight pipe portion arranged so as to be connected at a narrow angle A from an upper end of the first straight pipe portion toward a downward direction, and in which an intersection of connection between the first straight pipe portion and the second straight pipe portion is arranged at an upper position from an upper opening end of a lower opening portion of the second straight pipe portion;

a pump receiving case which receives a fuel pump, and in which a fuel inflow hole is open to a lower side and a vapor discharge hole is open to an upper side; and a fuel distribution pipe in which a fuel injection valve J is arranged so as to be inserted toward a fuel distribution path, wherein the fuel tube portion provided with the vapor return joint and the pressure regulator of said fuel flow path module is inserted into a fuel tank via a module insertion hole open to a bottom portion of the fuel tank, and the fuel flow path module is fixedly arranged in the fuel tank via an attaching collar portion, and wherein the fuel outflow hole and the fuel inflow hole are connected by a fuel inflow pipe, the vapor discharge hole and the vapor inflow hole are connected by a vapor relief pipe, the pump discharge path and the fuel distribution path are connected by a fuel outflow pipe, and a regulator fuel pipe branched from the fuel outflow pipe is connected to the regulator fuel inflow hole.

* * * * *